US008418783B2

(12) United States Patent
Saf et al.

(10) Patent No.: US 8,418,783 B2
(45) Date of Patent: Apr. 16, 2013

(54) BOOM ARRANGEMENT FOR A ROCK DRILL AND ROCK DRILL RIG

(75) Inventors: Fredrik Saf, Vintrosa (SE); Martin Ekefalk, Kumla (SE); Sven-Olov Nyström, Örebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 309 days.

(21) Appl. No.: 12/735,481

(22) PCT Filed: Jan. 26, 2009

(86) PCT No.: PCT/SE2009/000030

§ 371 (c)(1),
(2), (4) Date: Jul. 19, 2010

(87) PCT Pub. No.: WO2009/105005

PCT Pub. Date: Aug. 27, 2009

(65) Prior Publication Data

US 2010/0294570 A1 Nov. 25, 2010

(30) Foreign Application Priority Data

Feb. 20, 2008 (SE) ..... 0800393-1

(51) Int. Cl.
*E21B 7/02* (2006.01)

(52) U.S. Cl.
USPC ..... 175/122; 175/296; 173/42; 173/44; 173/184

(58) Field of Classification Search ..... 175/122, 175/162, 293, 296; 173/42, 190, 192, 44, 173/184
See application file for complete search history.

(56) References Cited

U.S. PATENT DOCUMENTS

| | | | | |
|---|---|---|---|---|
| 2,958,514 | A * | 11/1960 | Lee | 175/122 |
| 3,718,367 | A * | 2/1973 | Schumacher | 175/16 |
| 4,039,032 | A * | 8/1977 | Morrison | 175/122 |
| 4,968,978 | A * | 11/1990 | Stolarczyk | 175/40 |
| 5,139,097 | A * | 8/1992 | Rajala | 175/122 |
| 5,934,387 | A * | 8/1999 | Tuunanen | 175/162 |
| 6,131,674 | A | 10/2000 | Draney et al. | |
| 7,610,970 | B2 * | 11/2009 | Sihler et al. | 175/61 |

FOREIGN PATENT DOCUMENTS

| | | |
|---|---|---|
| EP | 1491719 A1 | 12/2004 |
| GB | 1583574 A | 1/1981 |
| WO | WO 02/103162 A1 | 12/2002 |

* cited by examiner

*Primary Examiner* — Frederick L Lagman
(74) *Attorney, Agent, or Firm* — Mark P. Stone

(57) ABSTRACT

A boom arrangement (7) for a rock drill rig (5) including a feed beam unit (8) for displaceable reception of at least one rock drilling machine (10, 10'), a support unit (13) for connection to and support of a rotator unit (12), a boom unit (11) between the rotator unit (12) and the feed beam unit (8) for displacement of the feed beam unit in planes essentially at right angle to a main plane (P) for the support unit (13), wherein the rotator unit (12) is arranged for rotating the feed beam unit (8) around an axis (A), which is essentially-perpendicular to said main plane (P), wherein the support unit (13) is connectable to a vehicle unit being part of the rock drill rig (5), and being arranged for displacing the rock drill rig. The support unit (13) has joint connecting elements (14) being sidewardly connectable for connection to a sidewardly directed carrier device (15, 17) which is attachable to the vehicle unit, and a lower abutment side (16) for lying supporting against an outer substrate. The invention also concerns a rock drill rig.

20 Claims, 6 Drawing Sheets

BOOM ARRANGEMENT FOR A ROCK DRILL AND ROCK DRILL RIG

FIELD OF THE INVENTION

The invention concerns a boom arrangement for a rock drill rig. The invention also concerns a rock drill rig including such a boom arrangement.

BACKGROUND OF THE INVENTION

During blast hole drilling for obtaining ore from ore bodies, that are disposed in thin strata (order of magnitude below one meter thick) a technology is used, wherein the aim is to avoid extracting more than necessary of the surrounding, non ore bearing rock. For that reason the drifts are made with as small dimensions as possible, and in particular as low as possible. Further, drill rigs are used which are operative in the ore body between the drifts, said drill rigs allowing extraction of ore and rock with a height just over about one meter in height.

It can be mentioned that as alternatives to such minimalized drill rigs, it is possible to further reduce the extraction of rock by means of handheld equipment. This at the price of inferior working environment for the workers.

A previously known drill rig of the above kind has been put on the market under the name "Stomec". The basic idea with this previously known drill rig was to separate the power unit, including motor-hydraulic pump, from the rig itself, which is provided with propulsion means in the form of crawlers, and a rig body, whereupon a boom with two feed beams is attached.

A tube arrangement supplies the rig unit with hydraulic oil, water and pressure air from the power unit.

Another example of the background art is a drill rig, having a conventional feeder, being supported by a short beam on each one of the front and rear sides of the rig. In this rig the motor and pump unit are disposed in the rig body and propulsion of the rig as well as operation of the drilling machines on the feeders is controlled over a radio link. This latter drill rig has i.a. the drawback that several functions are doubled, for example through the present of double beams, which results in increased costs. The rig further allows only drilling in one single direction which is a disadvantage in many narrow drift areas.

AIM AND MOST IMPORTANT FEATURES OF THE INVENTION

It is an aim of the invention to provide a boom arrangement and a rock drill rig as mentioned initially wherein the drawbacks of the background art are solved or at least reduced.

This is achieved in a boom arrangement and a rock drill rig as disclosed herein.

Hereby is obtained that the drilling can be preformed with a higher number of degrees of freedom as compared to what is possible with machines according to the background art and in particular that drilling is possible in different directions, that a solid support for the boom arrangement is provided and that a vehicle unit in a rock drill rig according to the invention will be more easy accessible for service when one end of the vehicle unit is made free from rock drilling equipment.

The arrangement also allows better driving properties during forward propulsion between two adjacent drillings as well as during driving longer distances, since a boom arrangement on one side only of the rock drill rig is easier drive controllable.

By the carrier device including a link system simplifies flexibility of the equipment.

It is preferred that said joint connecting elements are directed essentially horizontal and that they are arranged on an essentially horizontally directed side of the support unit. This results in uncomplicated connecting possibilities to the vehicle portion.

The feed beam unit is preferably connected to the boom unit such that it can be angled in vertical planes, which gives good adjustment possibilities.

It is preferred that the feed beam unit includes two feed beams, each being adapted for displaceably receiving at least one rock drilling machine. When each feed beam is rotatable around an axis which is parallel to its longitudinal axis, the flexibility increases and the possibility of fast re-adjustments. Drilling can also be controlled by one single operator although the feed beam unit includes two feed beams, since the feed beams are arranged beside each other and are freely visible at the same time by one single operator.

The rotator unit is preferably arranged on the support unit, displaceable in directions essentially parallel to the main plane. This gives good fine-adjustment possibilities. The rotator unit is hereby preferably arranged displaceable in parallel with directions for driving the rock drill rig, in operative condition of the arrangement and essentially in directions perpendicular to intended drilling directions in operative conditions of the arrangement.

The invention also concerns a rock drill rig, which exhibits a vehicle unit including engine means for generating propulsive power for the rig and for generating driving power for a connected boom arrangement including an inventive boom arrangement.

The vehicle unit includes hereby preferably connecting devices for connection with the boom arrangement concentrated on a front side.

It is preferred that the rock drill rig has a remote control device for increased control possibilities of all components and functions.

It is preferred that the rock drill rig has a control unit which is setable in a driving mode, wherein the support unit is disposed in a floating condition, whereby on the one hand the support unit maintains a decided angle to a horizontal plane in respect of the angle of the vehicle unit. On the other hand the support unit is disposed in an elevated position above a normal level for lying against said ground. Hereby simplified control during driving the rig is achieved.

Further advantages are obtained through further aspects of the invention, which is subject to further claims and will come clear from the description below.

BRIEF DESCRIPTION OF DRAWINGS

The invention will now be described in more detail by way of embodiments and with reference to the annexed drawings, wherein.

DESCRIPTION OF EMBODIMENTS

Figure 1:
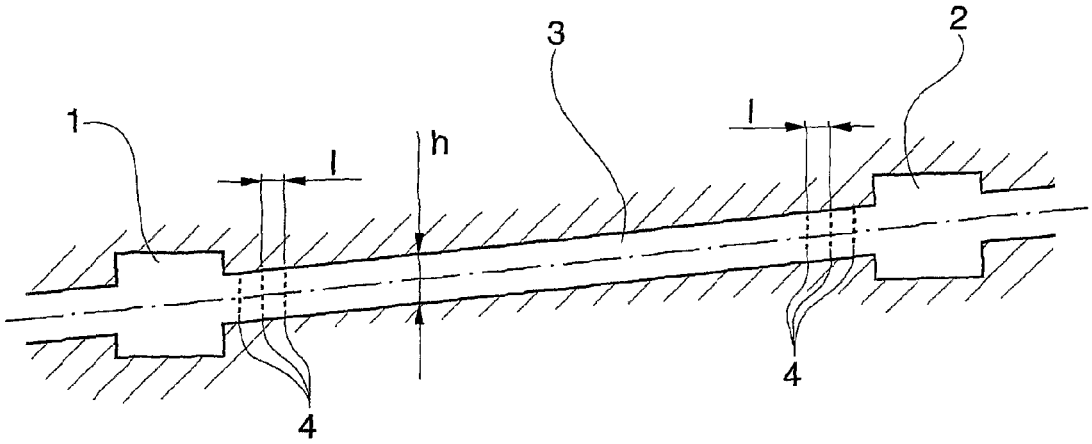
FIG. 1 shows diagrammatically a section through a portion of rock with drifts, wherein a device according to the invention is used.
Figure 2:
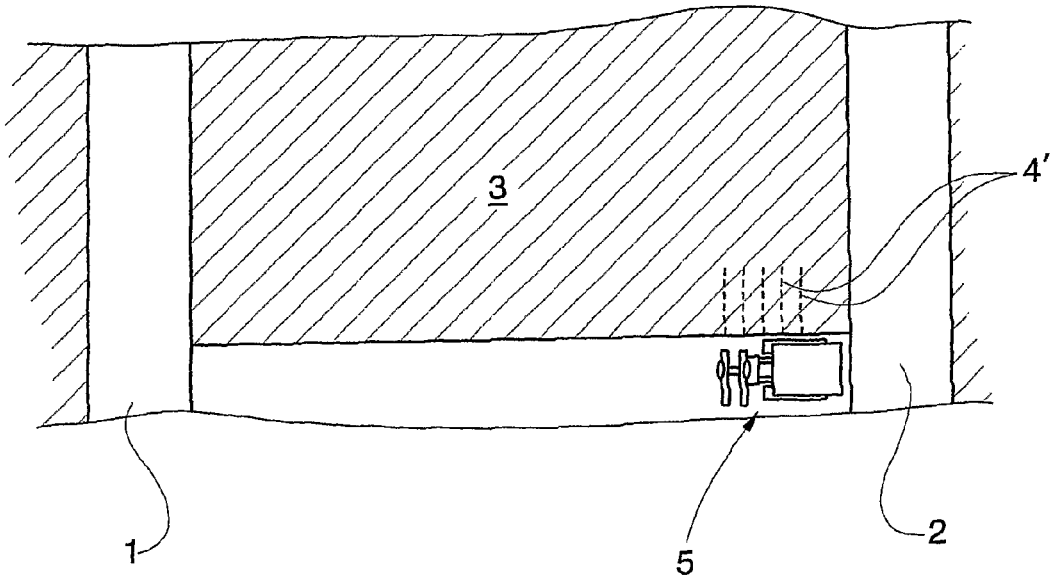
FIG. 2 shows the area in FIG. 1 in an imagined section seen from the above with a rock drill rig according to the invention in an operative position, FIGS. 3*a* and *b* show a rock drill rig according to the invention in a perspective view.

FIGS. 1 and 2 does show a typical working area for a rock drill rig according to the invention, wherein the reference numerals 1 and 2 indicate two parallel drifts, which are disposed in a typical mutual distance of about 20-30 meters in such a way that the space 3 therebetween includes a thin, wide ore body, the central portion of which being indicated by way of a dashed dotted line. The height h of the area 3 intended for blasting-out is in the order of magnitude of 1.2 meter.

4 indicates a number (all are not shown in FIG. 1) of blast holes, which are drilled with a rock drill rig according to the invention. A mutual distance 1 between the blast hole rows is typically about 500 mm. This distance is also often used between blast holes being position above each other.

In FIG. 2 is shown a rock drill rig 5 according to the invention in an operative position, and blast holes are shown indicated with 4'. Typically the lengths of the blast holes do not exceed about 3 meters in this kind of mining.

After that the entire width between the drifts 1 and 2 of the body 3 has been drilled with adequate number of holes, the drill area will be blasted, whereupon blasted material is collected and transported away from the area for subsequent extraction of valuable metals and minerals in the ore.

Figure 3A:
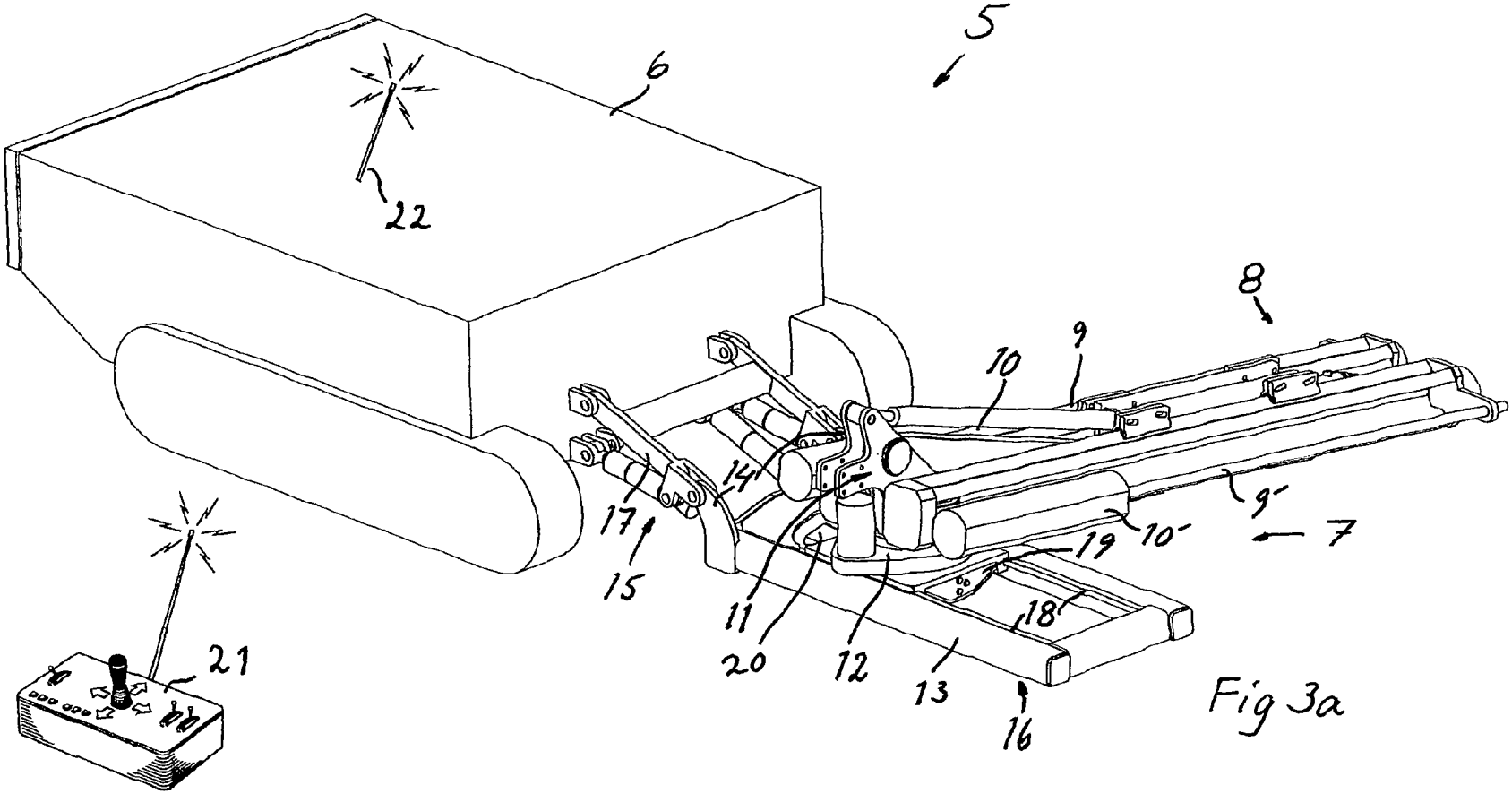

In FIGS. 3*a* and *b* the rock drill rig 5 is shown in more detail, wherein the rig includes a vehicle unit 6, wherein is enclosed one or more engines for propulsion of the rig as well as an engine-driven hydraulic pump for providing drive medium for the boom arrangement of the drill rig including operation of drilling machines. For that purpose the vehicle unit, besides a hydraulic pump, includes at least one diesel engine and/or an electric motor which can be connected to a network being present in the mine.

The vehicle unit 6 is connected to a boom arrangement 7, which has joint connecting elements 14 being connectable from the side for the connection to a carrier device in the form of a link system 17 with a system of hydraulic cylinders.

The carrier device 15 extends from one side, in particular a front side, of the vehicle unit 6. The boom arrangement includes a feed beam unit 8 including two feed beams 9 and 9', each one carrying a rock drilling machine 10, 10'. The feed beam unit 8 is in turn supported by a boom unit 11, which is pivotally attached to the feed beam unit 8, which can be angled in respect of the boom unit 11 by means of a (not shown) hydraulic cylinder in per se known manner.

The boom unit 11 includes a boom column 11' and a boom link 11" as well as hydraulic cylinders which control the angling in respect of a rotator unit 12 and a feed beam unit 8 in a manner which is per se known in conventional rigs.

The boom unit is on its lower end thus articulately arranged on a rotator unit 12, which allows rotation of the entire boom arrangement 7 at least 180° for drilling at right angles sideward in both directions from a main driving direction H for the rock drill rig 5.

Figure 3B:
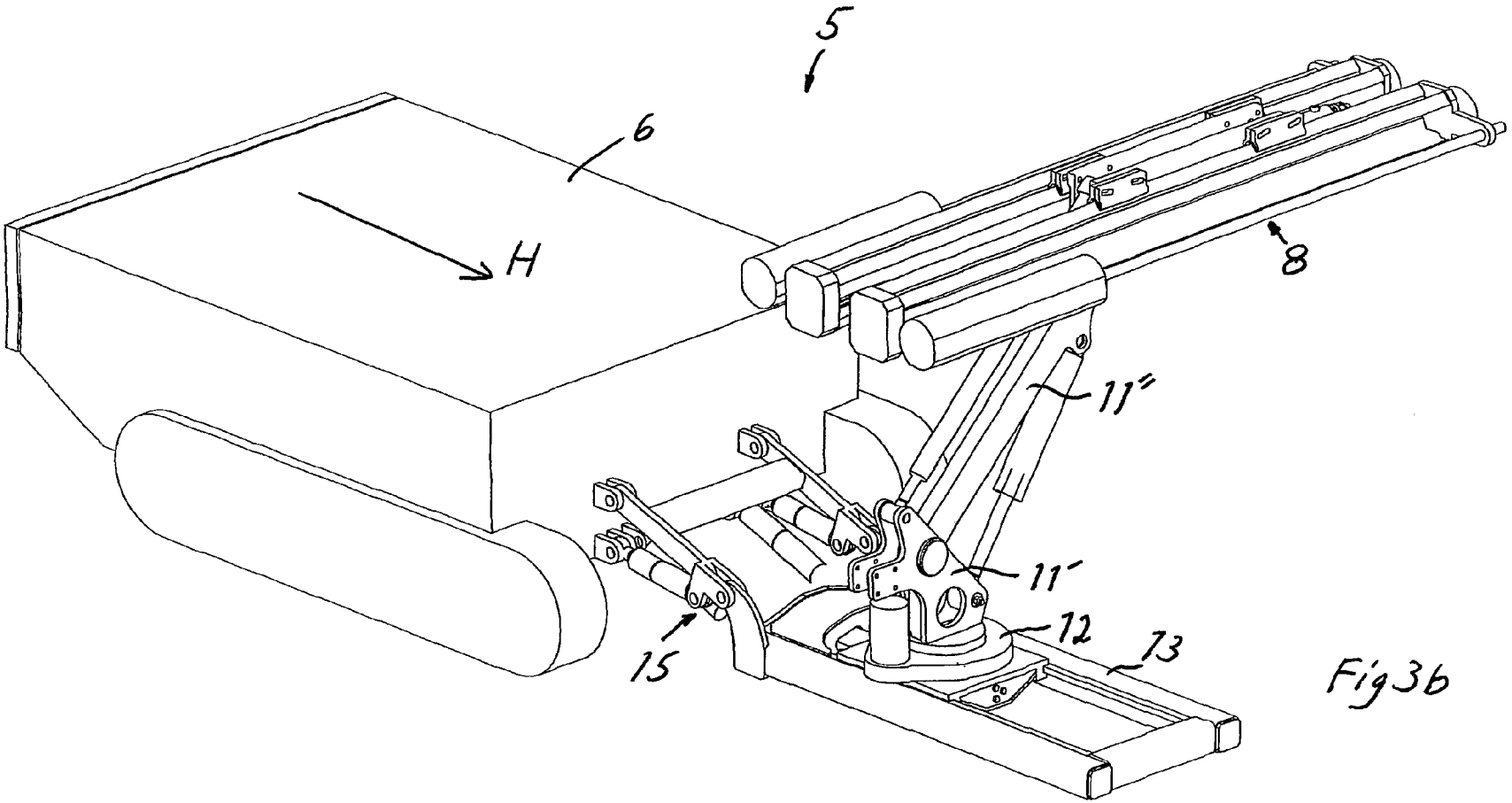

The rotator unit 12 on its bottom side (as is shown in FIG. 3) with a stationary portion attached to a fastening portion 19, which is slideable in slide guides 18 arranged longitudinally on a support unit 13.

The sideable fastening portion 19 is displaceable lengthwise on the support unit 13 by means of a piston cylinder aggregate 20. The aim of the displaceability of the fastening portion 19 and thereby the entire boom arrangement in respect of the support portion and the vehicle unit 6, is the possibility of providing fine-adjustment of the feed beam unit against a rock face in order to provide the blast holes at the intended positions with high position.

The support unit 13 further has a consol arrangement which is the carrier of (a part of) said joint connecting element 14.

The fastening arrangement of the feed beam unit 8 against the boom unit 11, is longitudinally displaceable in per se known manner which is not described further here.

The drill rig is, as is mentioned above, remote controlled, and suitably radio control. With 21 is indicated a control unit, which is handled by the operator for controlling all the functions of the drill rig. With 22 is indicated an antenna device for receiving radio signals from the unit 21. In practice the antenna 22 is arranged inside the cover of the vehicle unit.

Figure 4:
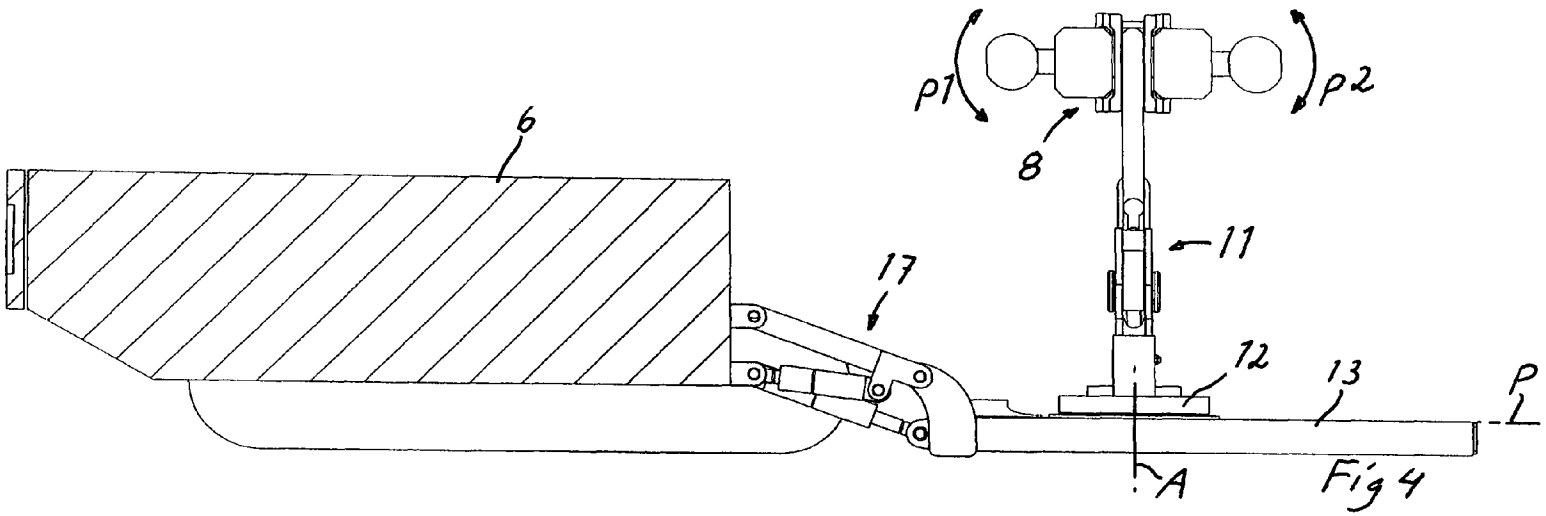
FIGS. 4, 5 and 6 show diagrammatical side views of the rock drill rig according to the invention in different operative positions.
Figure 5:
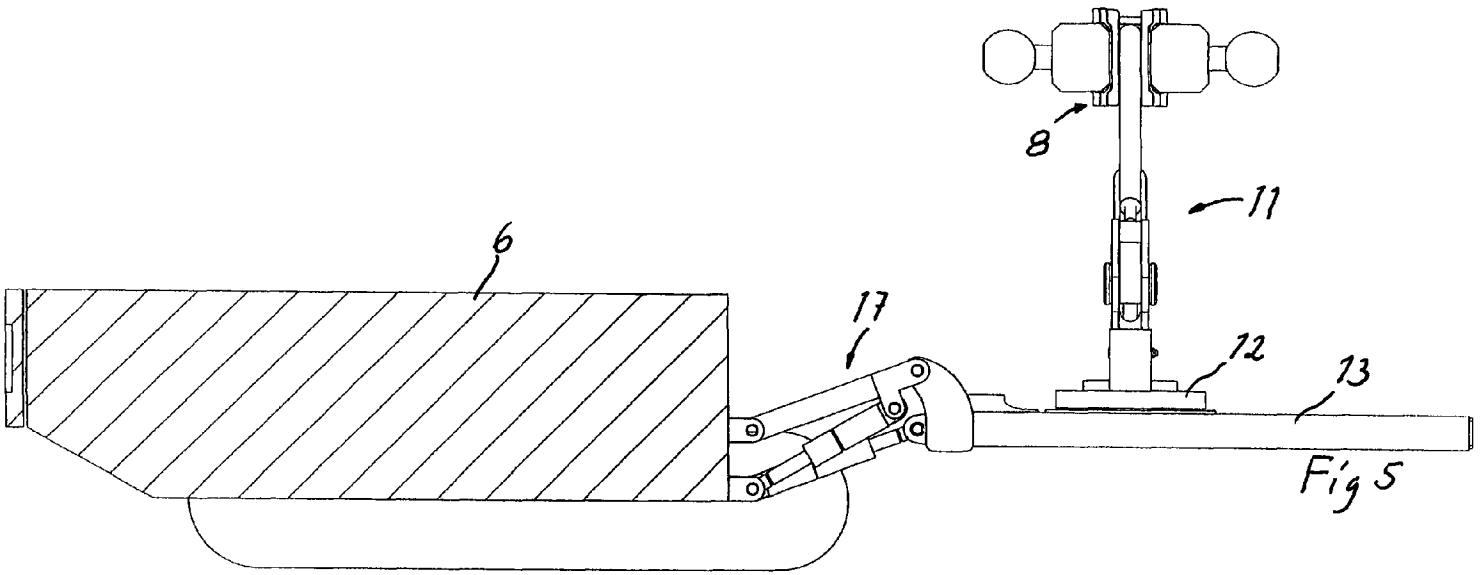
Figure 6:
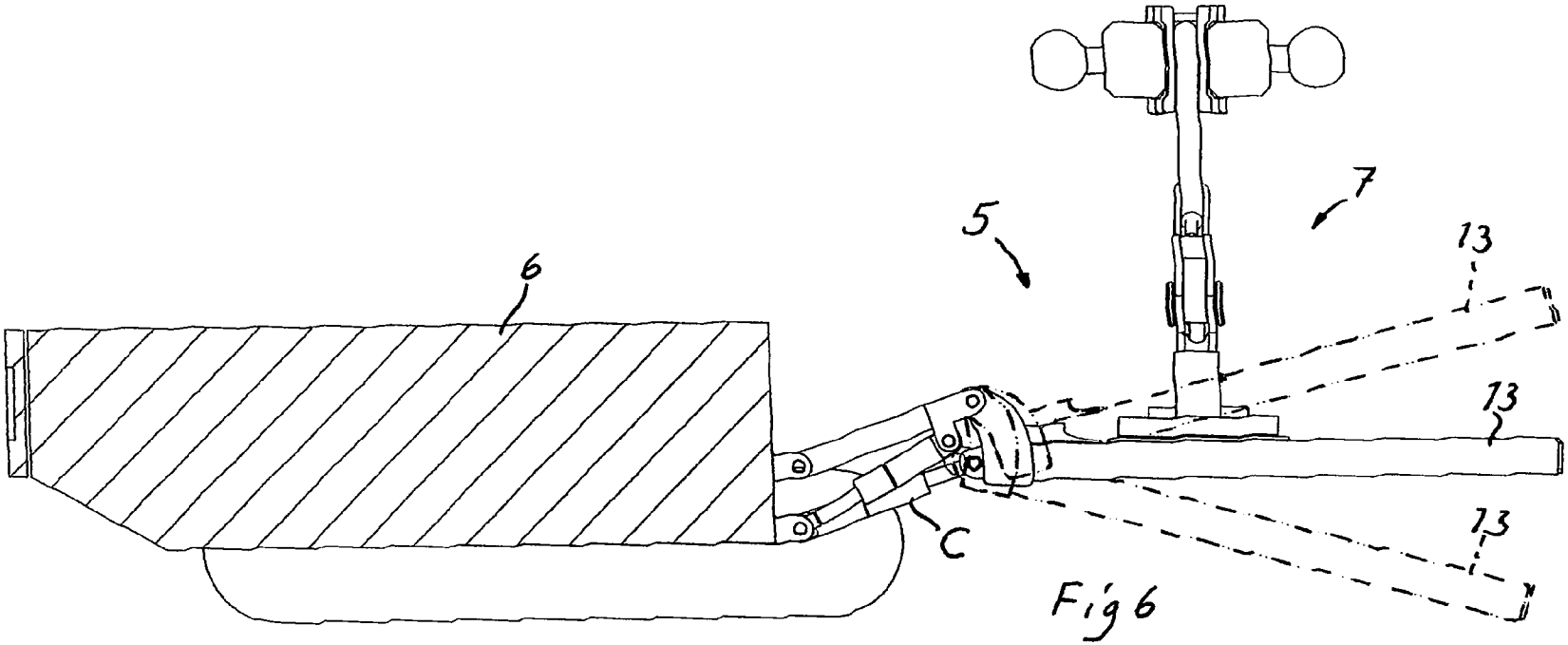

In FIGS. 4-6 is thus diagrammatically shown the drill rig in different positions, wherein in FIG. 4 is shown a position, wherein a support unit 13 is lowered for lying with its lower abutment surface 16 against an outer substrate in form of the so called rock floor. In this position very good availability is achieved for drilling sidewards, as well as a rigid platform for drilling. The rotator unit 12 is, as mentioned, adapted for rotation of the feed beam unit 8 around an axis A which is substantially perpendicular to a main plane P for the support unit. The arrows p1 and p2 indicate that the feed beams can be articulated around axis/axes being parallel to the drilling direction.

In FIG. 5 is shown the rock drill rig with the support unit somewhat upwardly through lifting by the link system in the form of a four joint mode thereof. In FIG. 6 is shown, starting out from the position in FIG. 5, that the support unit can be inclined upwardly and downwardly respectively, through actuation of a hydraulic cylinder C. From these Figures is to be understood that the rock drill rig according to the invention allows flexibility during driving and good adaptability during drilling, since great freedom is allowed for the mutual angling between the support unit and the vehicle unit.

Figure 7:
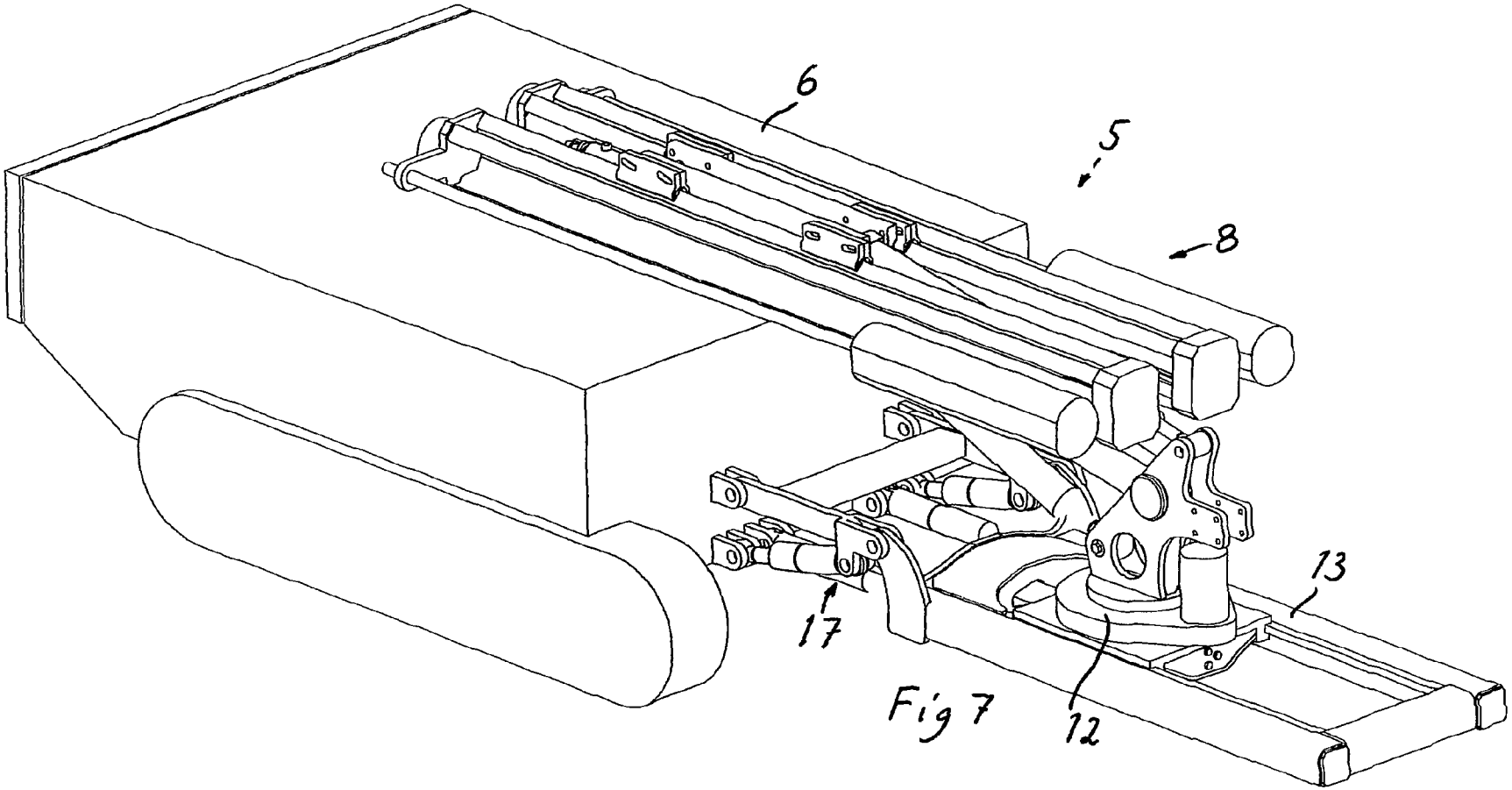
FIG. 7 shows a rock drill rig according to the invention in a perspective view in a driving position.

In FIG. 7 is shown a special transport position, wherein the support unit is lifted upwardly and the feed beam unit has been directed opposite to the direction of the link system 17 of the vehicle unit, such that it rests on the latter. The position in FIG. 7 is particularly useable during longer transfers and transports of the drill rig unit.

The invention can be modified within the scope of the annexed claims. The support unit 13 can thus be made without a particular slideable fastening unit in such a way that the rotator unit 12 is not displaceably arranged on the support unit 13.

The feed beam unit can include also one single feed beam. Irrespective of the presence of one or two feed beams, it/they can be rotatable around an axis or axes, which is/are parallel to the drilling direction. This would further allow a certain time-saving during line-up between drillings in the same position of the vehicle unit.

The link system can be arranged otherwise and also the portions of the boom arrangement 7, which are connected to the vehicle unit and to the link system, can be constructed otherwise.

The vehicle unit 6 has suitably a set of shutters or the like on its top side and lateral sides, respectively, for convenient axes to machinery inside the vehicle unit.

The invention claimed is:

1. Boom arrangement for a rock drill rig including a feed beam unit for displaceable reception of at least one rock drilling machine, a support unit for connection to and support of a rotator unit, a boom unit between the rotator unit and the feed beam unit for displacement of the feed beam unit in planes essentially at a right angle to a main plane for the support unit, wherein the rotator unit is arranged for rotating the feed beam unit around an axis, which is essentially perpendicular to said main plane, wherein the support unit is connectable to a vehicle unit being part of the rock drill rig, said vehicle unit being arranged for displacing the rock drill rig, wherein the support unit has joint connecting elements being sidewardly connectable for connection to a sidewardly directed carrier device which is attachable to the vehicle unit, and the support unit has a lower abutment side for lying supporting against an outer substrate.

2. Boom arrangement according to claim 1, wherein said carrier device includes a link system.

3. Boom arrangement according to claim 1, wherein said joint connecting elements are essentially horizontally directed.

4. Boom arrangement according to claim 1, wherein said joint connecting elements are arranged on a side of the support unit, which is directed essentially horizontally.

5. Boom arrangement according to claim 1, wherein the feed beam unit is attached to the boom unit in such a way that the boom unit can be angled in vertical planes.

6. Boom arrangement according to claim 1, wherein the feed beam unit includes two feed beams, each one being adapted for displaceable reception of at least one rock drilling machine.

7. Boom arrangement according to claim 1, wherein each feed beam is rotatable around an axis which is parallel to its length axis.

8. Boom arrangement according to claim 1, wherein the rotator unit is arranged displaceable on the support unit in directions essentially in parallel to the main plane.

9. Boom arrangement according to claim 8, wherein the rotator unit is arranged displaceable in parallel to directions for driving the rock drill rig in an operative condition of the arrangement.

10. Boom arrangement accordingly to claim 9, wherein the rotator unit is arranged displaceable essentially in directions perpendicular to intended drilling directions in an operative condition of the arrangement.

11. Rock drill rig which includes a vehicle unit including engine means for generating propulsive power for the rig and for generating drive power for a connected boom arrangement, wherein the rock drill rig includes a boom arrangement according to claim 1.

12. Rock drill rig according to claim 11, wherein the vehicle unit includes connecting devices for interconnecting with the boom arrangement concentrated on a front side.

13. Rock drill rig according to claim 11, wherein the rock drill rig comprises a remote control device.

14. Rock drill rig according to claim 11, wherein the rock drill rig comprises a control unit, which is settable in a driving mode, wherein the support unit is set in a floating position, wherein the support unit maintains a decided angle to a horizontal plane irrespective of an angle of the vehicle unit, and the support unit is in an elevated position above a normal level for lying against said outer substrate.

15. Boom arrangement according to claim 2, wherein said joint connecting elements are essentially horizontally directed.

16. Boom arrangement according to claim 2, wherein said joint connecting elements are arranged on a side of the support unit, which is directed essentially horizontally.

17. Boom arrangement according to claim 3, wherein said joint connecting elements are arranged on a side of the support unit, which is directed essentially horizontally.

18. Rock drill rig according to claim 12, wherein the rock drill rig comprises a remote control device.

19. Rock drill rig according to claim 12, wherein the rock drill rig comprises a control unit, which is settable in a driving mode, wherein the support unit is set in a floating position, wherein the support unit maintains a decided angle to a horizontal plane irrespective of an angle of the vehicle unit, and the support unit is in an elevated position above a normal level for lying against said outer substrate.

20. Rock drill rig according to claim 13, wherein the rock drill rig comprises a control unit, which is settable in a driving mode, wherein the support unit is set in a floating position, wherein the support unit maintains a decided angle to a horizontal plane irrespective of an angle of the vehicle unit, and the support unit is in an elevated position above a normal level for lying against said outer substrate.

* * * * *